United States Patent [19]

Andonov

[11] Patent Number: 4,926,626

[45] Date of Patent: May 22, 1990

[54] FLAMME FANCY YARN MANUFACTURING METHOD AND APPARATUS

[75] Inventor: Blagoy A. Andonov, Sofia, Bulgaria

[73] Assignee: N I T I "Veda", Sofia, Bulgaria

[21] Appl. No.: 214,236

[22] Filed: Jul. 1, 1988

[51] Int. Cl.[5] ..... D02G 3/34; D02G 3/38; D02G 5/32

[52] U.S. Cl. ..... 57/18; 19/237; 57/6; 57/91; 57/209; 57/317

[58] Field of Search ..... 57/2, 5, 6, 16–18, 57/90, 91, 317, 209; 19/237

[56] References Cited

U.S. PATENT DOCUMENTS

| | | | |
|---|---|---|---|
| 2,064,279 | 12/1936 | Taylor et al. | 57/91 X |
| 2,472,283 | 6/1949 | Byers | 19/237 |
| 2,905,976 | 9/1959 | Matthew et al. | 19/237 X |
| 2,948,931 | 8/1960 | Smith | 57/91 X |
| 3,695,019 | 10/1972 | Lappage | 57/91 |
| 4,368,611 | 1/1983 | Mainka et al. | 57/18 X |
| 4,418,523 | 12/1983 | Lemaire | 57/18 X |

FOREIGN PATENT DOCUMENTS 133791 4/1960 U.S.S.R. .

*Primary Examiner*—John Petrakes

[57] ABSTRACT

A method and apparatus for flamme fancy yarn manufacture for textile production of various number of effects along the length and in a given length of ready-made yarn, irrespective of the length of the fibres of the inlet product both from short staple and long staple material as the flamme fancy yarn is obtained by simultaneous feeding of two slivers with one and the same staple fibres length, as one of the slivers may not be subjected to a permanent force in the draft zone, it may be drawn normally without breaking to be used for the formation of a core thread. The apparatus for achieving the method has the advantage of an easy readjustable construction, and the ability to change the range of products without replacement of the performing elements.

3 Claims, 2 Drawing Sheets

FLAMME FANCY YARN MANUFACTURING METHOD AND APPARATUS

FIELD OF THE INVENTION

This invention relates to a method and apparatus for flamme fancy yarn manufacture for textile production.

BACKGROUND OF THE INVENTION

A known method for flamme fancy yarns manufacture is disclosed in USSR Author's Certificate No. 133,791 in which staple fibres of small length in the form of a sliver are drawn by a drafting apparatus, designed for drawing a sliver from long staple fibres. The sliver breaks and forms flamme effects, the latter being fed to the core thread obtained from long staple fibres simultaneously with the flamme (slub) effects. The thus obtained flamme effects are bound to the core thread by twist. The ready-made yarn is wound onto a bobbin.

The well known method is performed by a conventional drafting apparatus on a spinning machine or a flyer.

The disadvantage of the known method and apparatus are that only short staple fibres can be used for obtaining flamme effects, as the staple length is always considerably smaller than the length of the fibres of the core. The change of the number of flamme effects as per a given length of the ready-made yarn, in accordance with preliminary degree of draft alters the linear density of the core thread.

In USSR Author's Certificate No. 133,791 a device is shown for obtaining flamme fancy yarns, comprising a drafting apparatus with two zones, in which the upper cylinder of the intermediate pair of drawing rollers has a surface, part of which is formed by cylindrical and flat section in succession, thus allowing periodical drawing and breaking of the fed sliver. Binding means for the flamme effects binding to the core thread is provided, as well as a winding unit.

A disadvantage of the known device is that the number of flamme effects in a given length of the ready-made yarn, as well as their length are limited by the form of the surface of the upper cylinder, as the surface does not allow great variety of effects. Thus, for achieving different in size and frequency effects within the limited possibilities of the device, a design of expensive complete upper cylinders is necessary, as additional labour and time consumption is needed for their replacement as per each type of yarn.

SUMMARY OF THE INVENTION

It is an object of the present invention to create a method and apparatus for flamme yarn manufacture, of various numbers of effects along the length and in given length of the ready-made yarn, irrespective of the length of the fibres of the inlet product.

The task is solved by a method of obtaining flamme fancy yarns at continuous and at constant speed feeding of staple fibres at the form of at least one sliver. The sliver is subjected to drawing and breaking in succession in the draft zone. The broken bundles of fibres are delivered and bound to the core thread. According to the invention a force with permanent action is applied to the sliver as it is being drawn in the draft zone, at an angle toward the trajectory of the sliver path, and causes the breaking of the sliver being drawn and extending of the trajectory of the sliver path of the remaining broken sliver, fed without drawing into the draft zone after each breaking.

The task is solved by an apparatus for achieving the method, which include a drafting frame mounted on the body of the apparatus, which draft zone comprises a breaking means and next to the drafting frame in sequence are located a binding unit and a winding mechanism. According to the invention the breaking means comprises an operating element which consists as a whole of a shaft supported on the body about the middle of its length by a bearing, a funnel with a slit, shaped on the way of the running sliver to the end of one of the shaft's sides in relation to the bearing, and an extending arm protruding from the said side of the shaft near to the bearing, and brought into contact with a limiting leg mounted on the body of the apparatus, and at the other side of the shaft to its end is fixed one of the ends of a spring loading element. The spring loading element is a twist spring, with a free end formed as a hook, suspended on a pin, fixed to a pulley, slipped on the shaft and positioned to the body. The pulley has grooves on its circumferential peripheral surface by which is positioned with a flat spring mounted on the body.

The advantages of the method of flamme fancy yarn manufacture include its ability to achieve flamme effects, various in length and frequency, both from short staple and long staple materials, as the flamme fancy yarn is obtained by simultaneous feeding of two slivers with one and the same staple fibres length. As one of the slivers may not be subjected to a permanent force in the draft zone, it may be drawn normally without breaking and used for the formation of a core thread.

The apparatus for achieving the method has the advantage of easily readjustable construction, giving the possibility for a change of the range of products without replacement of the operating elements.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
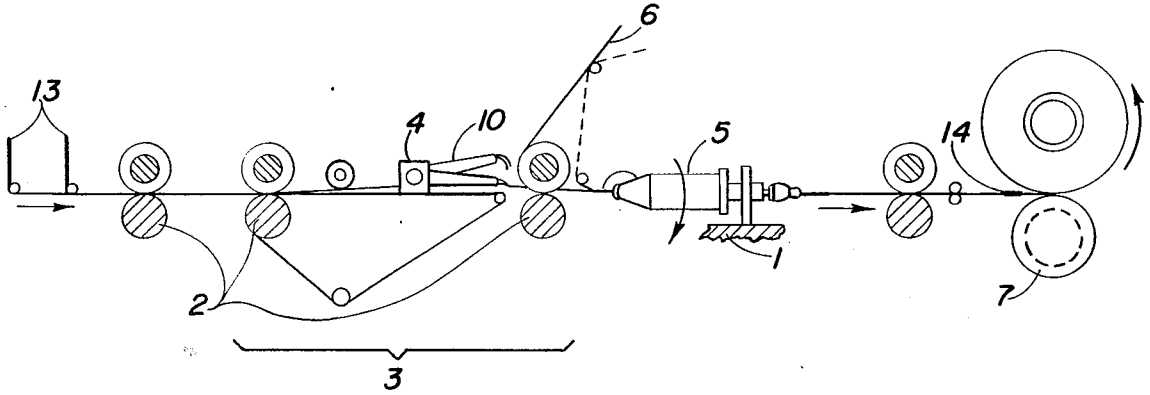
FIG. 1 is a side view of the apparatus for feeding the two slivers.
Figure 2:
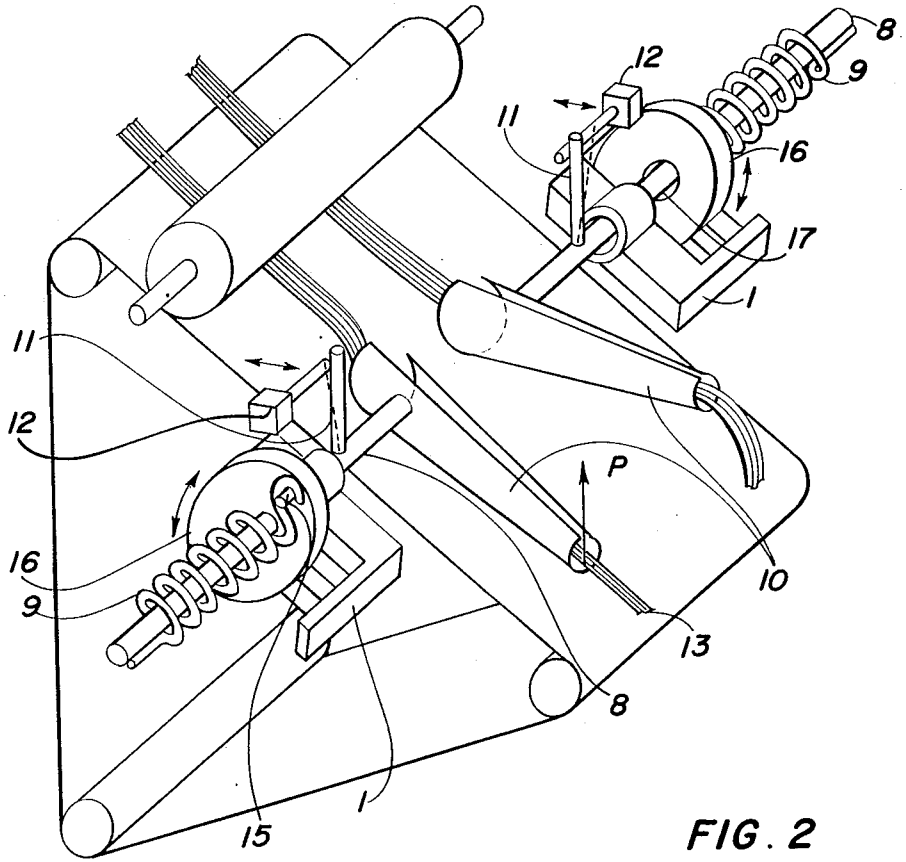
FIG. 2 is an axonometric view of the draft zone in the drafting apparatus and the two breaking means mounted in it, respectively for two slivers.

Referring to the figures, generally, the method of flamme fancy yarns manufacturing comprises feeding at a constant speed of staple fibres in the form of at least one sliver 13, the latter being subjected to drawing and broken in the draft zone 3. The broken off bundles of fibres are fed and bound to the core thread 6. The binding may be achieved by imparting a false twist at the simultaneous feeding of a binding thread or binding fibres, or by conventional twisting.

According to the invention, a force P with permanent action is applied to the sliver 13 as it is being drawn in the draft zone 3 at an angle (not shown) toward the direct trajectory of the sliver path AB and causes the breaking of the drawn sliver and extending of the trajectory of the sliver path AB'B after each of said breakings.

The apparatus for achieving the method includes a drafting frame 2 mounted on the body of the apparatus, which draft zone 3 comprises a breaking means 4 and next to the drafting frame 2 in sequence are located a binding unit 5 and a winding mechanism 7. The breaking means 4 comprises an operating element which consists as a whole of a shaft 8 supported on the body 1 about the middle of its length by bearing a funnel with a slit 10 shaped on the way AB of the running sliver to the end of one of the shaft's sides in relation to the bearing, and an extending arm 11 protruding from the said side of the shaft 8 near the bearing, and brought into contact with a limiting leg 12 mounted on the body of the apparatus, and at the other side of the shaft 8 to its end is fixed one end of a spring loading element 9. The spring loading element 9 substantially is a twist spring in which the free end is formed as a hook suspended on a pin 15 fixed to a pulley 16, slipped freely on the shaft through its central opening 17 and positioned to the body 1. The angle position of the pulley 16 is adjustable in accordance with the type of the fed sliver 13, and determines the extent of the elongation force applied to the direct trajectory AB of the drawn sliver 13 with permanent action P.

The apparatus functions as follows: In advance, according to the required frequency of the flamme effects in the ready-made yarn 14, the length and the type of the fed sliver 13 is determined and the degree of draft of the drafting frame 2 is regulated, the position of the limiting leg 12 is fixed, as well as the angle position of the pulley 16. At least one staple fibres sliver 13 is fed at a constant speed through the operating element 8, 9, 10, imposing the breaking force P, in the draft zone 3 of the drafting frame 2.

The sliver is subjected in sequence to drawing and breaking. The broken tufts of fibres are taken off by the delivery rollers of the drafting frame 2 and are added to the core thread 6 before or after those rollers and are wrapped together by binding thread during their false twisting and passing through a hollow spindle of the binding unit 5. The ready-made flamme fancy yarn 14 is then wound into a yarn package by means of a winding mechanism 7.

During the period of sliver drawing, the funnel with a slit 10 is held up in a horizontal position by sliver being drawn, threaded through it and stretched from the feeding point A to the delivery point B.

At the same time, shaft 8 is pivoted, the twisting spring 9 is additionally compressed, extending arm 11 is kept set-off from the limiting arm 12, and the drawn sliver is subjected to the action of a force P by the funnel with a slit 10. The funnel with a slit 10 operates as a lever arm, loading the sliver with permanent force P during its drawing.

As the drawn sliver grows thinner its strength and resistance smoothly decrease and an equilibrium state will be reached and passed over, the thinning sliver will be overloaded by the permanent force P and an event of a break of the drawn sliver will take place.

In this circumstance, nothing brings the funnel with a slit 10 in the horizontal position and spring loaded shaft 8 is pivoting back until the extending arm 11 has touched the limiting leg 12.

The funnel with a slit 10, in its turn, has done its backward working stroke.

During the breaking of the sliver being drawn, the fibers which are caught up by the pair of delivery rollers are delivered as a tuft through line BB of the nipping area, while the other fibers of the sliver are left in the draft zone 3, which front ends are in the said area, but do not reach the nipping line BB, are deflected backwards, sliding on the upper roller surface to the point B' by the backward working stroke of the funnel with a slit 10.

After the deflection of the front end of the broken sliver to the position B', the funnel with a slit 10 will remain stationary in its upper position until the running through it sliver has passed the distance [delta L] marked with dotted line B'B in the drawing. In this circumstance the running sliver in the draft zone 3 is not subjected to drawing, so its strength increases and its speed is determined substantially by the feeding rollers.

When the front end of the sliver sliding on the upper roller surface of the pair of delivery rollers covers the distance [delta L] and reaches point B of the nipping line, its speed suddenly increases, as the pair of delivery rollers run at a speed which is much higher than that of the pair of feeding rollers. As a result, the sliver in the draft zone 3 is stretched at first, constraining the funnel with a slit 10 to do its forward working stroke to the horizontal position and then to be subjected to drawing in the distance [L] of the direct trajectory sliver path under the action of the force P. Further away as the sliver being drawn grows thinner, the equilibrium state will be reached and passed over again, and a new event of a break of the sliver will occur.

In this above described manner, the funnel with a slit 10 is caused to move by the combined action of the twist spring 9, the pairs of feeding and delivery rollers; and the sliver, passing through their nipping lines AA and BB, in succession is being drawn and broken along the direct trajectory and is running without drawing along the extending trajectory.

The frequency of the breaking events depends on the length [delta L] of the distance B'B which is regulated by bringing the limiting leg 12 into different positions, and on the speed of the disconnected sliver, running along the extending trajectory, regulated by kinematic change of the speed of the pair of feeding rollers.

According to the invention, when two breaking means 4 are used, the apparatus allows elimination of the action of the force P for one of them, so the sliver 13 passing through it will not be subjected to breaking, and thus the core thread 6 will be formed on the apparatus, and to which core thread 6 the other breaking means will add broken tufts of fibres.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A method for producing flamme fancy yarn comprising the steps of continuously feeding at least one sliver of staple fibers at a constant speed into a draft zone;

drawing the sliver in the draft zone, and simultaneously applying a force with permanent action to the sliver at an angle toward the trajectory of the sliver path;

breaking the thinning sliver being drawn under the action of said force, and simultaneously adding the broken tuft of the sliver to a core thread;

extending, after each breaking of drawing sliver, the trajectory of the sliver path of the remaining broken sliver, fed without drawing into the draft zone;

recapturing the sliver remaining in the draft zone by front end delivery rollers, stretching the sliver in the draft zone and subjecting the sliver to a new drawing;

binding together the tuft and core thread and subsequent winding the ready-made yarn.

2. Apparatus for producing flamme fancy yarn comprising a body;

a draft frame mounted on the body of the apparatus which draft zone comprises a breaking means and next to the draft frame in sequence are located a binding unit and winding mechanism;

a funnel, an extending arm, a limiting leg, and a spring loading element;

said breaking means comprising an operating element which consists as a whole of a shaft, supported on the body about the middle of its length by a bearing, said funnel with a slit shaped on the way of the running sliver mounted to the end of the one side of the shaft in relation to the bearing and said extending arm protruding from the said side of the shaft near to the bearing and brought into contact with said limiting leg mounted on the body of the apparatus, and on the other side of the shaft to its end is fixed one of the ends of said spring loading element.

3. Apparatus as claimed in claim 2, further comprising pin and a pulley;

the spring loading element being a twist spring, having a free end formed as a hook suspended on said pin fixed to said pulley, slipped on the shaft and positioned to the body.

* * * * *